US010449651B2

(12) United States Patent
Stark et al.

(10) Patent No.: US 10,449,651 B2
(45) Date of Patent: Oct. 22, 2019

(54) QUICK ATTACHMENT ABRASIVE ASSEMBLY FOR POWER CONCRETE TREATING MACHINES

(71) Applicant: DIAMOND PRODUCTIONS LTD., Montreal (CA)

(72) Inventors: Harvey Stark, Montreal (CA); Pavel Ikonomov, Laval (CA)

(73) Assignee: DIAMOND PRODUCTIONS LTD., Montreal, Quebec (CA)

( * ) Notice: Subject to any disclaimer, the term of this patent is extended or adjusted under 35 U.S.C. 154(b) by 206 days.

(21) Appl. No.: 15/596,317

(22) Filed: May 16, 2017

(65) Prior Publication Data

US 2018/0333820 A1 Nov. 22, 2018

(51) Int. Cl.

| | |
|---|---|
| ***B24B 7/18*** | (2006.01) |
| ***E04F 21/24*** | (2006.01) |
| ***B24D 5/06*** | (2006.01) |
| ***B24D 5/16*** | (2006.01) |

(52) U.S. Cl.

CPC ..... *B24B 7/186* (2013.01); *B24D 5/06* (2013.01); *B24D 5/16* (2013.01); *E04F 21/245* (2013.01)

(58) Field of Classification Search

CPC . B24B 7/18; B24B 7/186; E01C 19/22; E04F 21/245; E04F 21/247; E04F 21/248

See application file for complete search history.

(56) References Cited

U.S. PATENT DOCUMENTS

| | | | | |
|---|---|---|---|---|
| 6,869,344 | B2 * | 3/2005 | Miyahara | B24B 7/228 451/287 |
| 7,481,602 | B2 * | 1/2009 | Lampley | E04F 21/245 404/112 |
| 8,475,235 | B2 * | 7/2013 | Kilgren | B24B 7/186 451/350 |
| 10,046,438 | B2 * | 8/2018 | Tchakarov | B24D 13/14 |
| 2012/0270483 | A1 * | 10/2012 | Bae | B24B 7/186 451/540 |
| 2017/0291272 | A1 * | 10/2017 | Stark | B24B 7/18 |
| 2018/0126510 | A1 * | 5/2018 | Stark | B24B 7/18 |

* cited by examiner

*Primary Examiner* — Timothy V Eley
(74) *Attorney, Agent, or Firm* — Dewitt LLP; Thomas J. Nikolai

(57) ABSTRACT

For use with a power trowel, an abrasive assembly attachable to a rotatable arm of the power trowel that comprises a circular, rigid plate having a central hub projecting out from a first major surface and affixed to its second major surface is a ring of a resilient material. Adjacent the resilient ring is a molded plastic ring in which a plurality of permanent magnet members are imbedded at regularly spaced intervals. The plastic ring further includes at least, one boss projecting outward from a surface thereof and designed to fit within an aperture disposed in an outermost ring, which is entirely or partially of a ferrous metal and which carries a plurality of abrasive members on its outer surface. The resilient ring is fastened to the rigid plate by internally threaded tubular pins and the plastic ring is secured by screws that pass through the plastic ring into the lumens of the internally threaded tubular pins.

9 Claims, 2 Drawing Sheets

QUICK ATTACHMENT ABRASIVE ASSEMBLY FOR POWER CONCRETE TREATING MACHINES

CROSS-REFERENCED TO RELATED APPLICATIONS

None

STATEMENT REGARDING FEDERALLY SPONSORED RESEARCH OR DEVELOPMENT

None

BACKGROUND OF THE INVENTION

I. Field of the Invention

This invention relates generally to power trowels for working newly poured concrete slabs and, more particularly, to an abrasive head for attachment to a power trowel having provision for quick removal and replacement of diamond abrasive slab contacting surfaces.

II. Discussion of the Prior Art

In preparing a concrete slab as a building floor, forms are set up and then wet concrete is poured into the area defined by the forms. While still in a flowable state, the concrete is screeded and floated to yield a generally level surface with the gravel submerged. Once the concrete begins to harden, it is troweled to remove irregularities such as pits and bumps that may be present to thereby yield a smooth finish. For larger areas, power trowels are commonly used. They are generally of two types, walk-behind and ride-on. These machines are relatively expensive. Often concrete floors in commercial buildings are later treated (after the concrete has cured) by polishing machines that drive abrasive floor-engaging pads to create a smooth, polished and attractive surface. The polishing machines are also relatively costly. It is therefore advantageous if the same machine used to perform the earlier troweling operation can subsequently be rapidly and inexpensively converted to permit it to be used in performing the concrete polishing operations.

When it is recognized that workers necessarily must change out the abrasive pads frequently to present variation in the grit size being utilized at different stages of the polishing operation where a coarse grit is initially used, nut graduating to finer grits depending on the ultimate appearance that is desired, it is desirable that one be able to perform the machine conversion and abrasive substitution procedure simply, quickly and easily.

It is accordingly a principle object of the present invention to provide an improved abrasive assembly for attachment to a power trowel and in which abrasive members can be rapidly and accurately replaced.

SUMMARY OF THE INVENTION

In achieving the foregoing object, there is provided a circular plate of a predetermined diameter with a central hub affixed to a first major surface thereof and designed for attachment to the plural arms of a conventional power trowel upon removal of the trowel blades from the arms. Disposed adjacent to a second major surface of the circular plate is a ring formed of a resilient material whose outer diameter is also of said predetermined diameter. A plastic ring is placed adjacent to the resilient ring and imbedded in the plastic is a plurality of circumferentially spaced-apart permanent magnets. The plastic ring also includes at least one boss that extends out from a surface of the plastic ring.

The plastic ring and the resilient ring are attached to the circular disk by a plurality of fasteners. Completing the assembly is an outer ring, at least partially of a ferrous metal such as steel and having apertures through its thickness dimension and spaced for receiving one of the bosses therethrough to thereby align the steel embodying ring on the assembly as the force of attraction afforded by the permanent magnets hold the steel ring in place. Diamond abrasive pads are affixed in advance to an exposed major surface of the outer ring. It is not required that the outer ring be entirely of steel. It, too, can be of plastic, but with ferrous metal slugs embedded therein in alignment with the permanent magnets in the adjacent plastic ring.

With this arrangement, to replace a plurality of abrasive pads with ones of differing grit size, one need only pull apart the steel ring away from the assembly by overcoming the magnetic force afforded by the permanent magnets and substituting a new steel ring having abrasive pads already affixed to it.

BRIEF DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
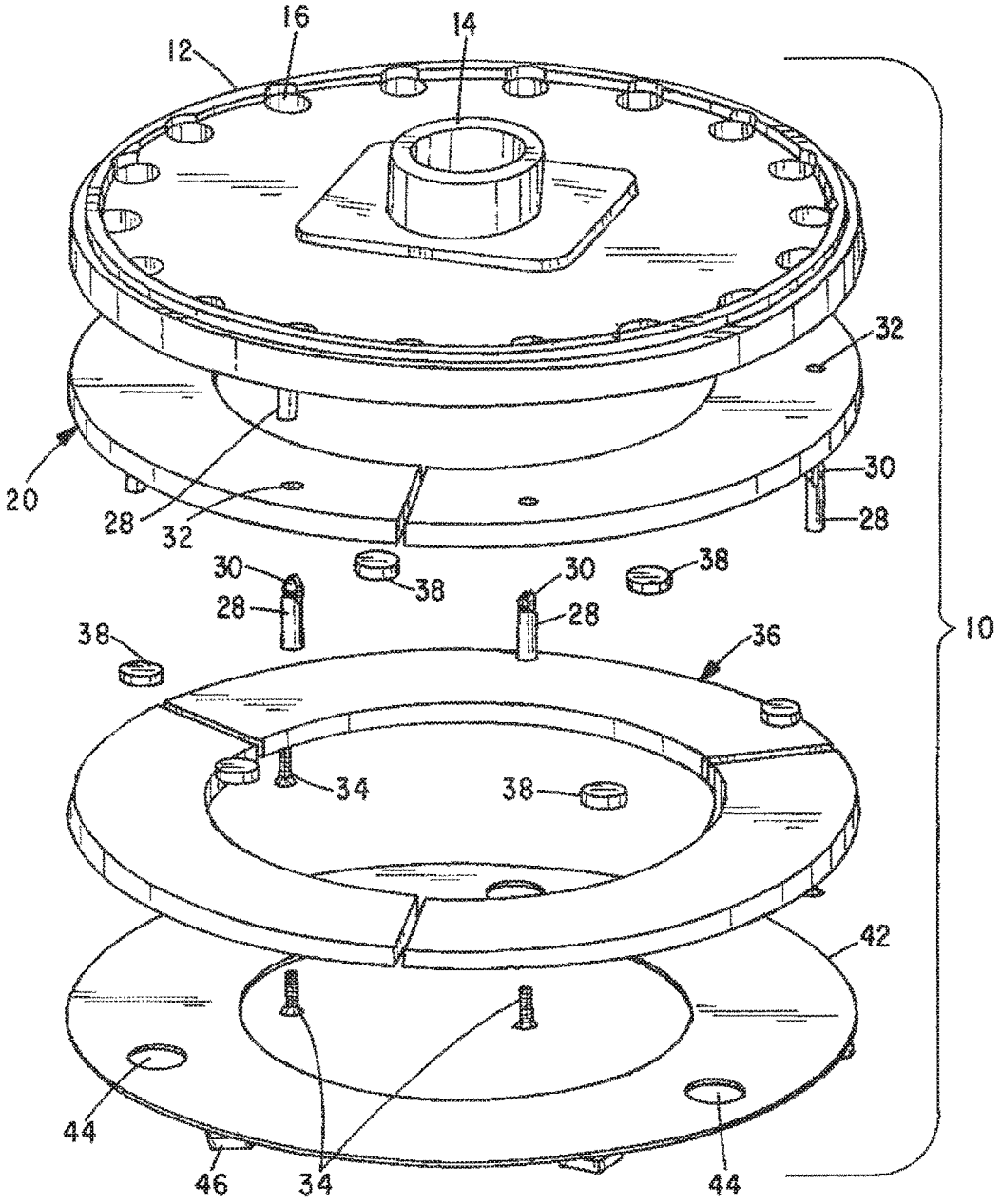
FIG. 1 is an exploded perspective view of a preferred embodiment of the present invention.

The description of the preferred embodiment is intended to be read in connection with the accompanying drawings, which are to be considered part of the entire written description of this invention. In the description, relative terms such as "lower", "upper", "horizontal", "vertical", "above", "below", "up", "down", "top", and "bottom", as well as derivatives thereof (e.g., "horizontally", "downwardly", "upwardly", etc.), should be construed to refer to the orientation as then described or as shown in the drawings under discussion. These relative terms are for the convenience of description and do not require that the apparatus be constructed or operated in a particular orientation. Terms, such as "connected", "connecting", "attached", "attaching", "join", and "joining", are used interchangeably and refer to one structure or surface being secured to another structure or surface or integrally fabricated in one piece, unless expressly described otherwise.

Figure 2:
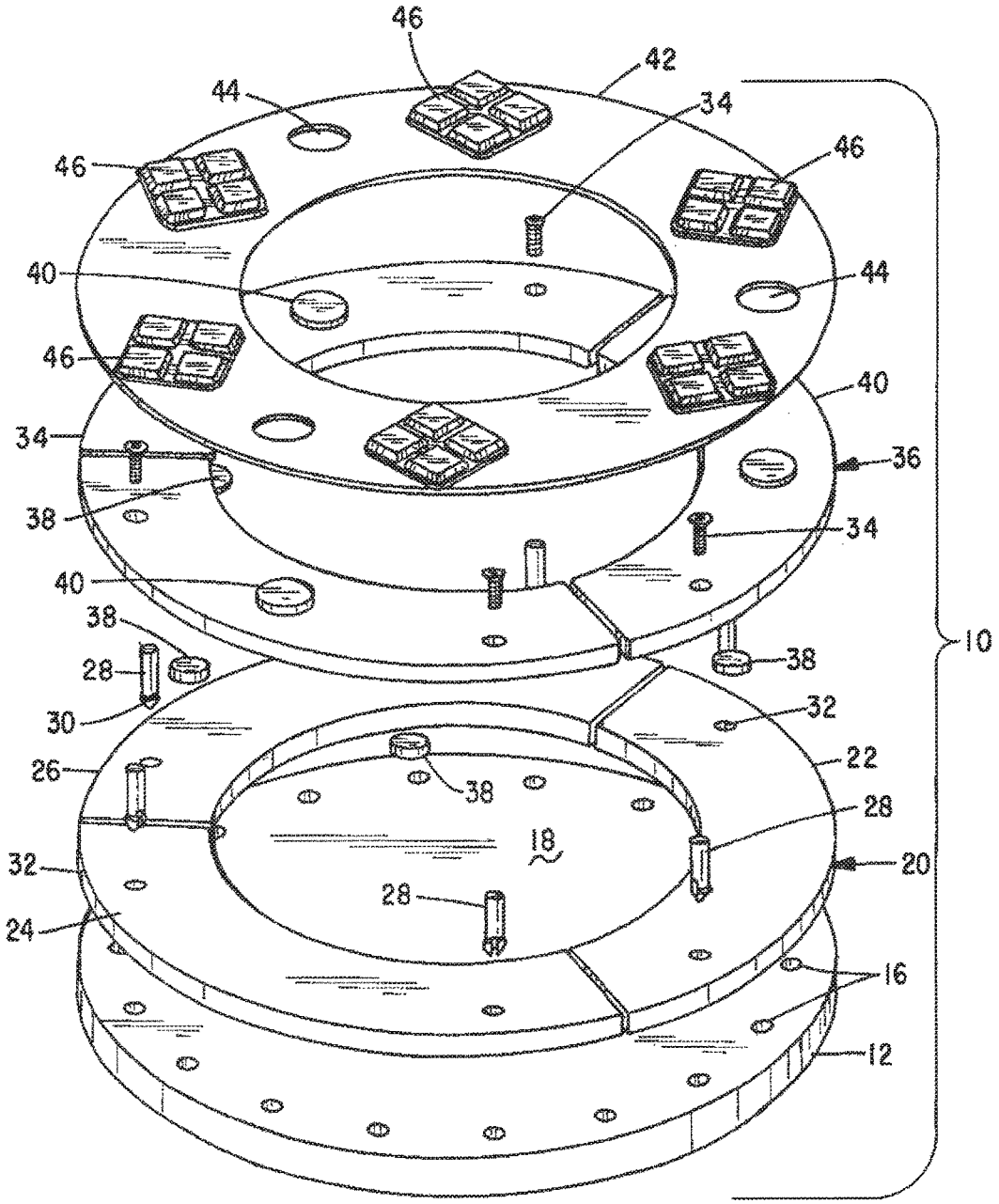
FIG. 2 is an exploded perspective view when viewed from the underside.

In FIG. 1, the drive plate assembly is indicated generally by numeral 10 and is seen to include a circular plate 12 having a centrally located hub 14 adapted for attachment to an arm extension of a power trowel so as to be rotatable thereon as the arms of the power trowel are made to sweep in a circular orbit. The plate 12 is preferably fabricated from a solid, rigid polymeric material and includes a plurality of regularly circumferentially spaced apertures as at 16 that extend through the thickness dimension of the plate. As seen in FIG. 2, the plate 12 has a flat undersurface 18.

Affixed to the undersurface 18 of the plate 12 is a flat annulus or ring 20 which may be continuous, but preferably is segmented into 120 degree segments 22, 24 and 26. The ring 20 is preferably formed from a resilient material such as rubber or a spongy foam plastic. The segments of the resilient ring 20 are fastened to the plate 12 by special tubular fasteners, as at 28, having a split pointed head 30 that pass through apertures 32 formed through the resilient ring segments and into selected ones of the apertures 16 formed in the plate 12. The apertures 16 are sized so that the split heads 30 on the fasteners 28 compress when driven into the apertures 16 on the plate 12 to create a firm friction fit. The tubular fasteners 28 are internally threaded.

Fastened against the resilient ring 20 by screws 34 is a molded plastic ring 36 which likewise may be segmented into 120 degree segments. During fabrication of the plastic ring 36 in a molding operation, a plurality of permanent magnet members 38 are placed in the meld so as to become imbedded in the plate at predetermined desired locations there around. Alternatively, following formation of the plastic ring, bores may be drilled into its thickness dimension and the permanent magnets press fit into the bores.

With continued reference to FIG. 2 and the features of the plastic ring 36, it is to be noted that circular bosses 40 project upwardly from the flat surface of the plastic ring 36.

Completing the assembly, in accordance with one embodiment, is a thin, somewhat flexible outer ring 42 having apertures 44 adapted to receive the bosses 40 of the plastic ring 36 therethrough. The outer ring 42 may be of a ferrous metal such as steel and will be held in place by the attractive force created by the permanent magnets 38 imbedded in the plastic ring 36. Attached to the exposed surface of the outer ring 42 are diamond chip impregnated abrasive pads, as at 46, that are suitably bonded to the outer surface of the outer ring 42.

In accordance with a further embodiment, the ring 42 carrying the abrasive pads thereon need not be entirely of steel. Instead, it may be of a polymeric material on or in which ferrous metal slugs are provided which become aligned with the magnets 38 when being joined to the ring 36.

In either case, the ring 42 with its attached abrasive pads 46 should be considered as a disposable item once the abrasive pads become unduly worn. To remove the outer ring 42 from the remainder of the assembly only requires an operator to grasp and lift away the ring 42 with sufficient force to overcome the force of attraction afforded by the permanent magnets imbedded in the plastic ring 36. Attachment of a replacement only involves aligning the apertures 44 in the replacement ring 42 with the bosses 40 on the plastic ring 36 and again, the permanent magnets will attract and hold the ring 42 in intimate contact with the plastic ring 36.

By segmenting the resilient ring 20 and the plastic ring 36 and by using a thin steel or plastic outer ring 42, the composite tool 10 is somewhat flexible and is better able to accommodate unevenness in a floor or slab being troweled.

The above-described preferred embodiment can readily be substituted for the blades of a conventional power trowel, allowing the machine to also serve as a concrete polisher. When so used, the steel plate 42 carrying the abrasive pads can be easily and rapidly changed without the need for any special tools to thereby vary the grit size being employed in going from course to fine.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A drive plate assembly for a power concrete treating machine comprising, in combination:

(a) a circular plate of a predetermined outer diameter with first and second major surfaces and with a central hub affixed to the first major surface and adapted for coupling to a rotatable shaft;

(b) a ring having said predetermined outer diameter formed from a resilient material, the ring abutting the second major surface of the circular plate;

(c) a rigid flat, plastic ring having said predetermined outer diameter having a plurality of permanent magnets imbedded in the plastic ring at regularly, circumferentially spaced intervals, the flat plastic ring including a plurality of integrally formed bosses projecting outward from one major surface of the flat, plastic ring;

(d) a flat, outer ring having said predetermined outer diameter having apertures formed through a thickness dimension thereof and positioned on the flat, plastic ring such that the bosses on the flat, plastic ring fit into the apertures of the flat, outer ring, the flat, outer ring being at least partially of a ferrous metal so as to be attracted against the flat, plastic ring by the plurality of permanent magnets; and (e) a plurality of abrasive pads affixed to an exposed major surface of the flat, cuter ring.

2. The drive plate assembly of claim 1 and further including a plurality of tubular fasteners for attaching the ring of resilient material to the circular plate.

3. The drive plate assembly of claim 2 wherein the tubular fasteners have an internally threaded lumen.

4. The drive plate assembly of claim 3 and further including a plurality of screws passing through apertures in the flat, plastic ring and screwed into the internally threaded lumen of the tubular fasteners.

5. The drive plate assembly of claim 1 wherein the resilient material is a rubber.

6. The drive plate assembly of claim 1 wherein the resilient material is a plastic foam.

7. The drive plate assembly of claim 1 wherein the ring formed from a resilient material is segmented.

8. The drive plate assembly of claim 1 wherein the rigid plastic, flat ring is segmented.

9. The drive plate assembly of claim 1 wherein the abrasive pads comprise diamond chips.

* * * * *